US006655678B2

(12) United States Patent
Spatafora et al.

(10) Patent No.: US 6,655,678 B2
(45) **Date of Patent: *Dec. 2, 2003**

(54) SUCTION GRIPPING UNIT

(75) Inventors: Mario Spatafora, Bologna (IT); Franco Carini, Bologna (IT)

(73) Assignee: G. D Societa' per Azioni, Bologna (IT)

( * ) Notice: Subject to any disclaimer, the term of this patent is extended or adjusted under 35 U.S.C. 154(b) by 74 days.

This patent is subject to a terminal disclaimer.

(21) Appl. No.: 09/849,443

(22) Filed: May 4, 2001

(65) Prior Publication Data

US 2002/0003331 A1 Jan. 10, 2002

Related U.S. Application Data

(63) Continuation-in-part of application No. 09/264,933, filed on Mar. 9, 1999, now abandoned.

(30) Foreign Application Priority Data

Mar. 11, 1998 (IT) ..... BO98A0147

(51) Int. Cl.[7] ..... B65H 3/12

(52) U.S. Cl. ..... 271/94; 271/5; 271/11; 271/108

(58) Field of Search ..... 271/5, 11, 94, 271/96, 99, 108

(56) References Cited

U.S. PATENT DOCUMENTS

| | | | | |
|---|---|---|---|---|
| 3,649,002 | A | 3/1972 | Burkhardt | 271/12 X |
| 4,009,876 | A | 3/1977 | Smiltneek | 271/99 |
| 4,513,957 | A | 4/1985 | Schaefer, Jr. | 271/90 |
| 5,511,772 | A | 4/1996 | Ganz et al. | 271/108 X |
| 6,250,218 | B1 * | 6/2001 | Carini et al. | 101/37 |

FOREIGN PATENT DOCUMENTS

| | | |
|---|---|---|
| DE | 1946361 | 4/1971 |
| EP | 0317232 | 5/1987 |
| EP | 0775655 | 5/1997 |

OTHER PUBLICATIONS

English Abstract of EP 775655 Dated May 28, 1997.

* cited by examiner

*Primary Examiner*—John Q. Nguyen
(74) *Attorney, Agent, or Firm*—Ladas & Parry

(57) ABSTRACT

A suction gripping unit (7; 107) having a suction head (15; 115), which has a cavity (18; 118) for gripping a blank, is connected to a suction pump (14) by a conduit (20; 120) controlled by a valve (22; 122) housed inside the conduit (20; 120) and reciprocated between an open and a closed position; the suction gripping unit (7; 107 is provided with a venting hole (23; 123) for automatically venting the cavity (8; 118) when the valve (22; 122) is in the closed position.

6 Claims, 5 Drawing Sheets

SUCTION GRIPPING UNIT

This application is a continuation-in-part of Ser. No. 09/264,933 filed Mar. 9, 1999 abandoned.

BACKGROUND OF THE INVENTION

The present invention relates to a suction gripping unit.

In the following description, specific reference is made purely by way of example to the cigarette packing sector, and in particular to a suction gripping unit for supplying blanks on a cigarette packing machine.

Cigarette packing machines are known to employ a suction gripping unit for feeding blanks successively between a blank pickup station, located at a blank store, and a supply station where the blanks are transferred to respective seats on a packing wheel.

Known suction gripping units such as those described in U.S. Pat. Nos. 4,513,957, 3,649,002 and 5,511,772 comprise a gripping head having a cavity connected through a conduit to a vacuum source and a valve for selectively interrupting the communication between the cavity and vacuum source. Some of the known units are also provided with venting holes for venting the cavity when the gripping head has to release the blank. The known units are not satisfactory when the blanks have to be transferred to a cigarette packing machine with an output close to twenty packets per second. For achieving that output the unit should permit a rapid alternation of vacuum and atmospheric pressure inside the cavity.

SUMMARY OF THE INVENTION

It is an object of the present invention to provide a suction gripping unit designed to eliminate the aforementioned drawbacks, and which in particular is cheap and easy to produce.

According to the present invention there is provided a suction gripping unit comprising at least a gripping head rotating about an axis and having at least one cavity defined in said suction head; suction means for creating a vacuum inside said cavity, said suction means comprising a conduit communicating with said cavity, a suction connected to said conduit and a control valve located between said pump and said cavity movable between an open position in which said cavity is in communication with the pump and in a closed position in which said valve interrupts the communication between the cavity and the pump; wherein the suction gripping unit comprises at least a venting hole in close proximity to the valve for automatically venting said cavity when said valve is in the closed position.

BRIEF DESCRIPTION OF THE DRAWINGS

The invention will now be described by way of example with reference to the accompanying drawings, in which.

DETAILED DESCRIPTION OF THE INVENTION

Figure 1:
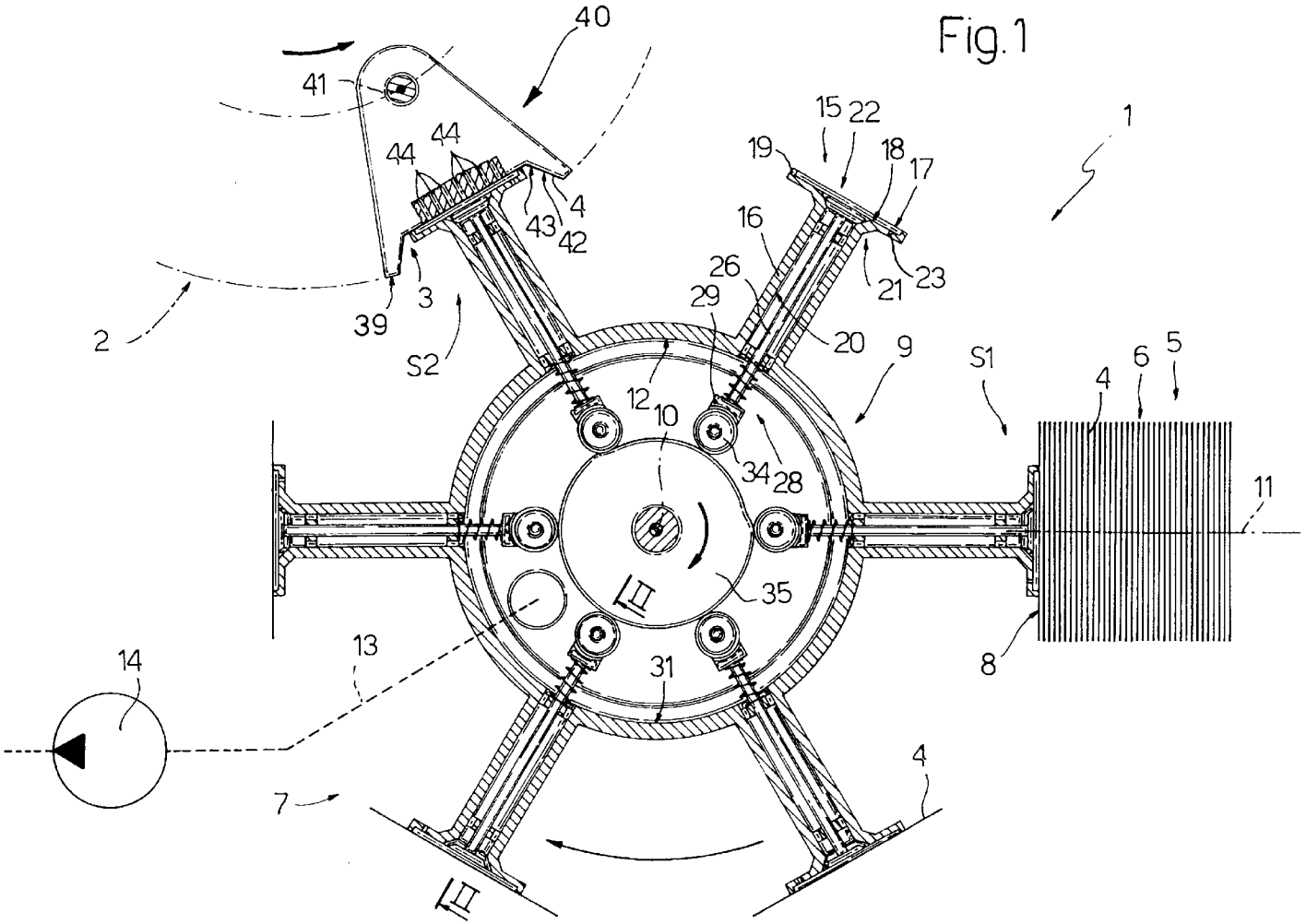
FIG. 1 shows a cross section, with parts removed for clarity, of a preferred embodiment of the unit according to the present invention.

Number 1 in FIG. 1 indicates as a whole a continuous packing machine comprising a powered packing wheel 2, which rotates continuously (anticlockwise in FIG. 1) about a respective axis (not shown) perpendicular to the FIG. 1 plane, and in turn comprises a number of hollow, equally spaced, peripheral seats 3 (only one shown) for successively receiving respective prefolded blanks 4 of cardboard or similar material Machine 1 also comprises a store 5 for a stack 6 of blanks 4; and a suction gripping unit 7 interposed between a pickup station S1 at the open end 8 of store 5 and a supply station S2 at packing wheel 2, and for extracting blanks 4 from end 8 and feeding them successively to respective seats 3.

Gripping unit 7 comprises a powered roller 9 rotating continuously clockwise in FIG. 1 about a respective fixed central axis 10 parallel to the axis (not shown) of wheel 2 and perpendicular to a longitudinal axis 11 of store 5. Roller 9 comprises an inner chamber 12 connected by a conduit 13 to a suction pump 14, preferably a so-called "side-channel" pump, for creating in chamber 12 a vacuum with respect to the atmospheric pressure outside.

Roller 9 supports a number of pneumatic gripping heads 15 distributed about axis 10 and connected to roller 9 via the interposition of respective arms 16. As shown more clearly in FIG. 2, each head 15 is substantially in the form of a plate, which is connected on one side to respective arm 16, and is defined on the other side by a gripping surface 17 in which a cavity 18 is defined by an annular edge 19 and connected to chamber 12 by a respective conduit 20 formed along respective arm In the embodiment shown, gripping surface 17 is substantially defined by the top surface of edge 19.

At a joint 21 connecting conduit 20 to respective head 15, each conduit 20 houses a valve 22 for controlling conduit 20, i.e. for opening or closing conduit 20 to connect or disconnect it from respective cavity 18. A through hole 23 is formed in each head 15 so that respective cavity 18 communicates permanently with the outside atmosphere.

Each valve 22 is a known mechanical valve, and comprises a head 24; an annular seat 25 engaged by head 24 and formed at respective joint 21; and a control rod 26, which is fitted in axially-sliding manner to two perforated supporting walls 27 (FIG. 3) housed inside conduit 20, and is moved axially, by an actuating device 28 and in a radial direction with respect to axis 10, between an open position (FIG. 2*a*) in which cavity 18 is connected pneumatically to conduit 20 and therefore to chamber 12, and a closed position (FIG. 2*b*) in which cavity 18 is isolated pneumatically from conduit 20 and therefore from chamber 12.

Actuating device 28 comprises a body 29, which is fitted to the end of respective rod 26 opposite the end connected to respective head 24, and is fitted to roller 9 so as to slide, together with rod 26, in a radial direction with respect to axis 10 and so move rod 26 between said open and closed positions. Actuating device 28 comprises a spring 30, which is located radially with respect to a wall 31 defining chamber 12 and coaxially with respect to respective rod 26, and is compressed between a respective wall 27 and body 29 to normally maintain rod 26 in said closed position.

Actuating device 28 also comprises a cylindrical rod 32, which is fitted to body 29 so as to slide longitudinally, with respect to body 29, along a respective axis 33 parallel to axis 10, and is fitted in rotary manner at one end with a tappet roller 34 cooperating with a fixed cam 35. Cam 35 is so formed that, as roller 9 rotates about axis 10, body 29, and therefore respective rod 26, of each head is is moved, in a radial direction with respect to axis 10, between said open position and said closed position.

Figure 4:
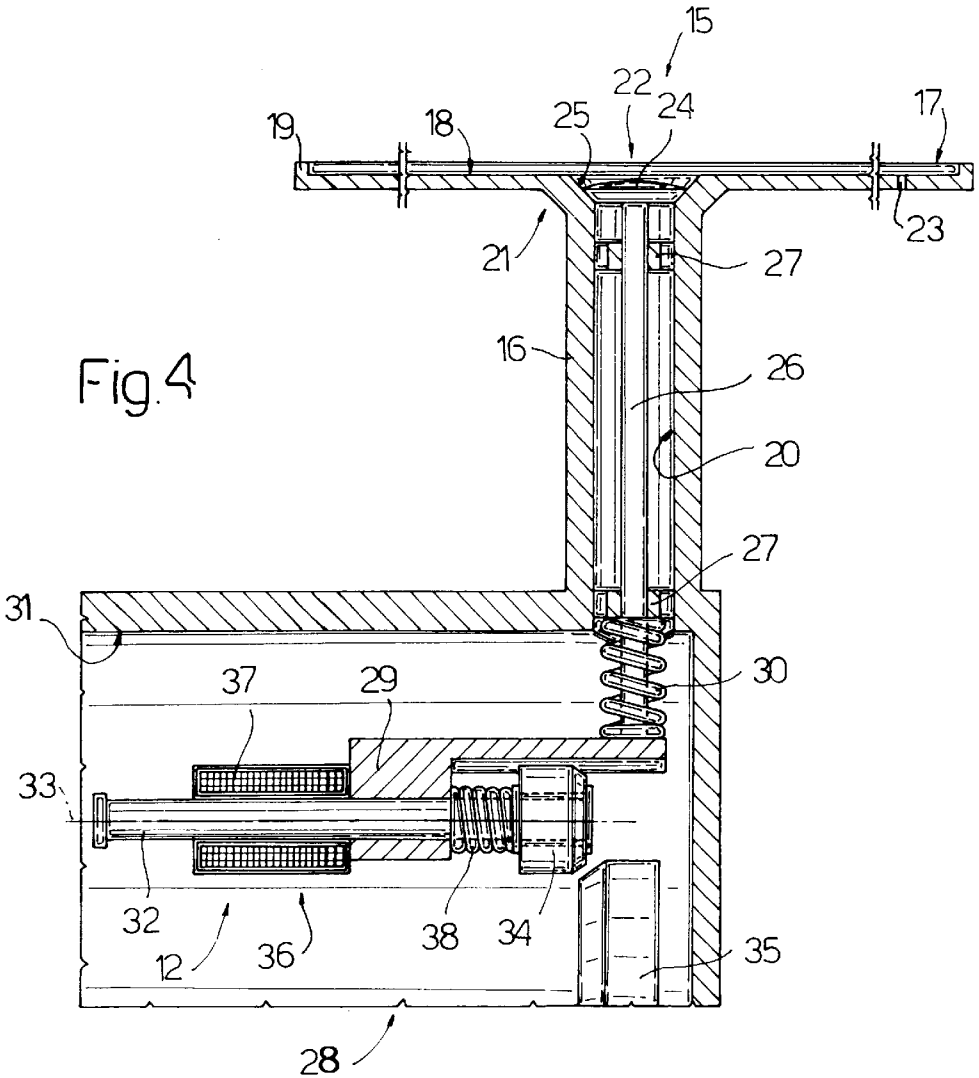
FIG. 4 is similar to FIG. 2 and shows a FIG. 2 detail in a further operating position.

The movement of rod 32 along axis 33 is controlled by an actuating device 36 for cutting off control of respective valve 22, and which moves rod 32 between a work position (FIG. 2) in which roller 34 engages cam 35, and a rest position (FIG. 4) in which roller 34 is detached from cam 35. Actuating device 36 comprises a known magnetic actuator 37 which, when energized, moves rod 32 along axis 33 from said work position to said rest position; and a spring 38 located coaxially with rod 32 between body 29 and roller 34 to normally maintain rod 32 in said work position.

As shown in FIG. 1, each seat 3 is formed in an outer surface 39 of a respective head 40 opposite an inner portion of head 40 connected to wheel 2 so as to oscillate, with respect to wheel 2, about a respective axis 41 parallel to axis 10 under the control of a known cam-rocker arm control device not shown. Each seat 3 comprises two lateral surfaces 42 sloping towards each other and towards a bottom surface 43 through which are formed a number of holes 44 by which a known suction device (not shown) communicates externally.

Figure 2:
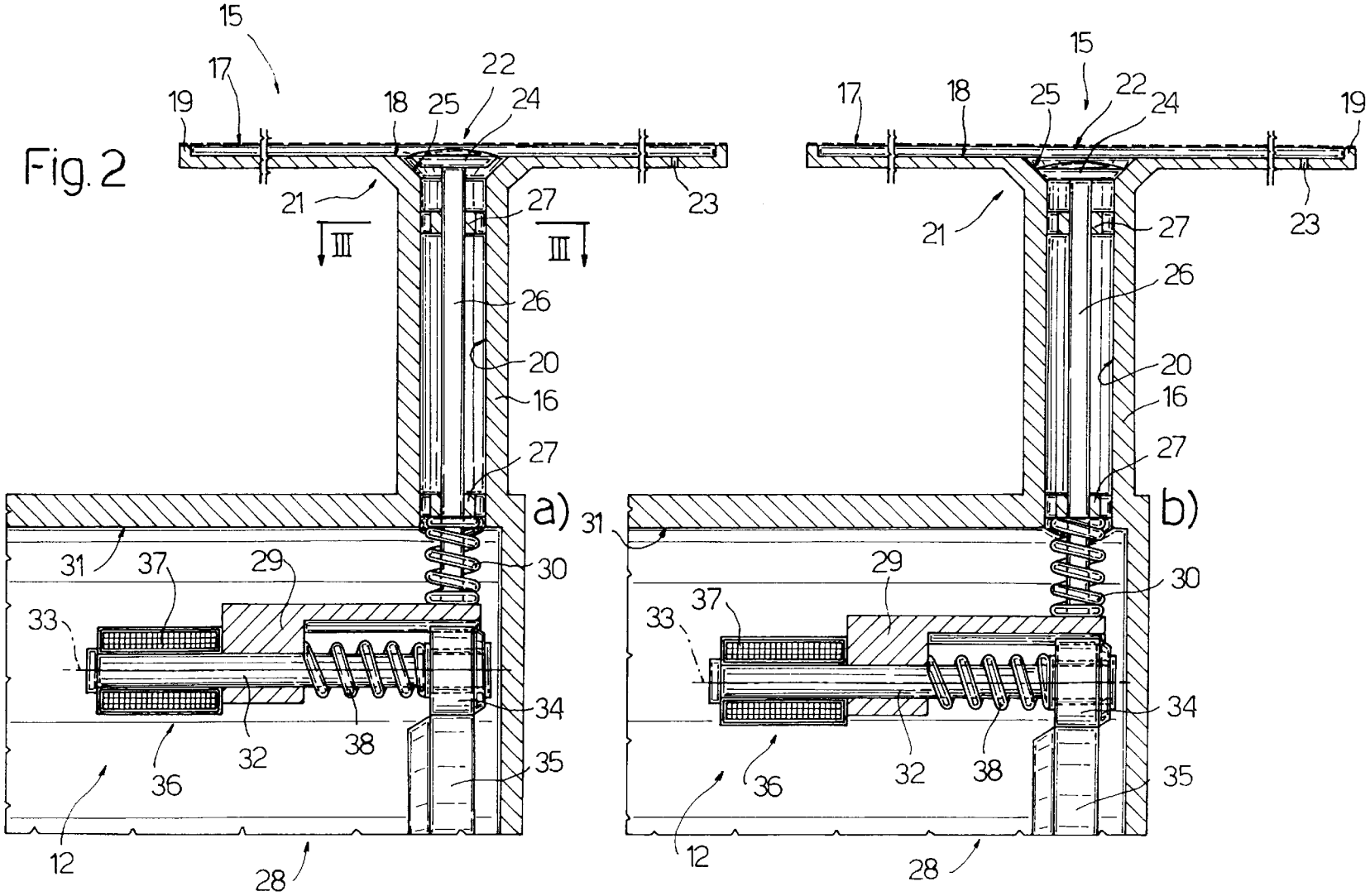
FIG. 2 shows a larger-scale section along line II—II in FIG. 1 of a FIG. 1 detail in two different operating positions.
Figure 3:
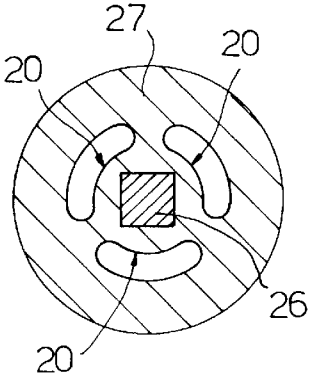
FIG. 3 shows a section along line III—III in FIG. 2.

The operation of one gripping head 15 will be described with reference to FIG. 2.

To retain a blank 4 on gripping surface 17 of head 15, surface 17 is brought into substantial contact with blank 4, which closes respective cavity 18 to define, with cavity 18, a suction chamber in which a vacuum (with respect to atmospheric pressure) is formed by closing respective valve 22 and so connecting said suction chamber to chamber 12 in which pump 14 maintains a constant vacuum.

The load losses caused by through hole 23 connected permanently to the outside pose no serious problems, by pump 14 being capable of compensating even relatively high load losses, such as those induced by hole 23.

To release blank 4, atmospheric pressure is restored inside said suction chamber automatically, by virtue of hole 23, by simply closing valve 22.

The relatively small volume of the suction chamber provides for achieving extremely rapid response of gripping head 15, which at the same time is cheap and easy to produce by comprising only one valve 22.

Operation of gripping unit 7 will be described with reference to FIG. 1, with reference to one gripping head 15, and as of the instant in which head 15, having released a blank 4 inside a respective seat 3 at supply station S2, is moved by the rotation of roller 9 towards pickup station S1 to withdraw another blank 4.

Between supply station S2 and pickup station S1, valve 22 of head 15 is maintained in said closed position.

As it is fed through station S1, gripping head 15 withdraws the blank 4 contacting end 8 of store 5 and retains it by suction on gripping surface 17. More specifically, at a given point in its movement, gripping head 15 is positioned with gripping surface 17 substantially contacting the blank 4 contacting end 8; and, just before said position is reached, actuating device 28 moves valve 22 into said open position to connect cavity 18 to chamber 12 and, via cavity 18, activate the suction force causing the blank 4 contacting end 8 to adhere to gripping surface 17.

As roller 9 rotates, head 15 leaves pickup station S1 in which blank 4 has been withdrawn, and is fed to supply station S2 where blank 4 is fed to a respective seat 3 on a respective head 40.

At station S2, head 40 is oscillated in known manner about respective axis 41 by said known cam-rocker arm device (not Shown) so as to remain a given length of time facing gripping surface 17 of head 15. During this time, head 15 is inserted inside seat 3 so that gripping surface 17 is positioned substantially contacting surface 43; and, just before said position is reached, actuating device 28 moves valve 22 into said closed position to cut off the suction through cavity 18, and the suction through holes 44 in surface 43 is activated to release blank 4 inside and adhering by suction to seat 3.

As shown in FIG. 1, the insertion of head 15 inside respective seat 3 provides for folding blank 4 into a U along respective known preformed bend lines (not shown) as blank 4 is fed into seat 3.

The above operations are repeated cyclically.

To prevent a blank 4 from being fed into a seat 3, the respective head 15 must be prevented from withdrawing a blank 4 as it travels through station S1, which function is provided for by actuating device 36 of head 15. More specifically, throughout the passage of head 15 through station S1, respective magnetic actuator 37 is maintained energized to detach roller 34 from cam 35 and so prevent respective valve 22 from being opened, so that, in the absence of suction, gripping surface 17, as it travels through station S1, is brought into contact with, but fails to withdraw, the blank 4 at end 8.

In a further embodiment not shown, cavity 18 is divided into a number of elementary cavities separated and maintained pneumatically connected to one another by perforated sections; and surface 17 is defined by the top surface of edge 19 and by the top surfaces of said sections to provide a larger supporting surface for blank 4.

In yet a further embodiment not shown, cavity 18 communicates permanently with the outside atmosphere via a number of small-diameter through holes 23.

Figure 5:
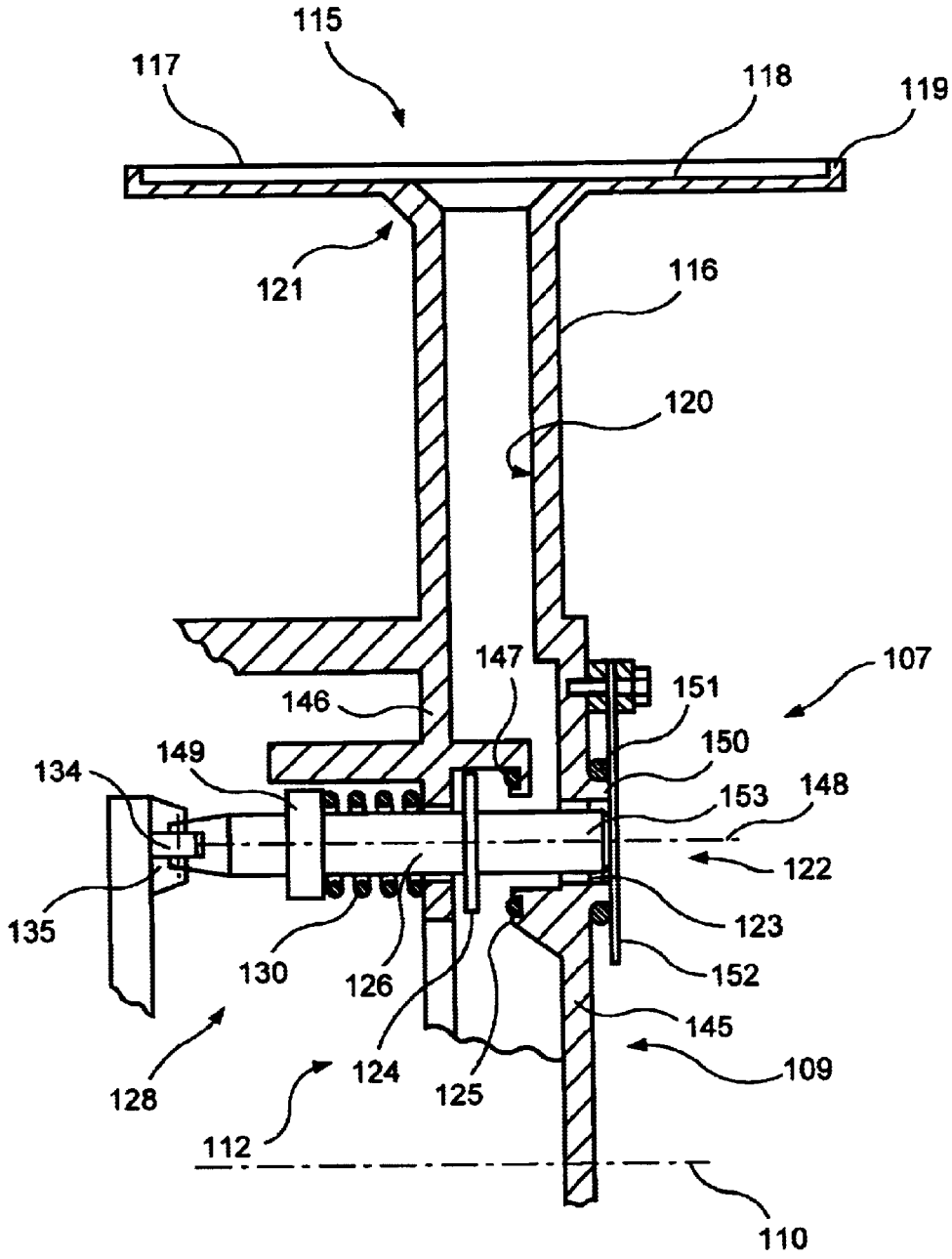
FIG. 5 shows a cross section of a portion of a further preferred embodiment of the gripping unit according to the present invention in a first operating position.
Figure 6:
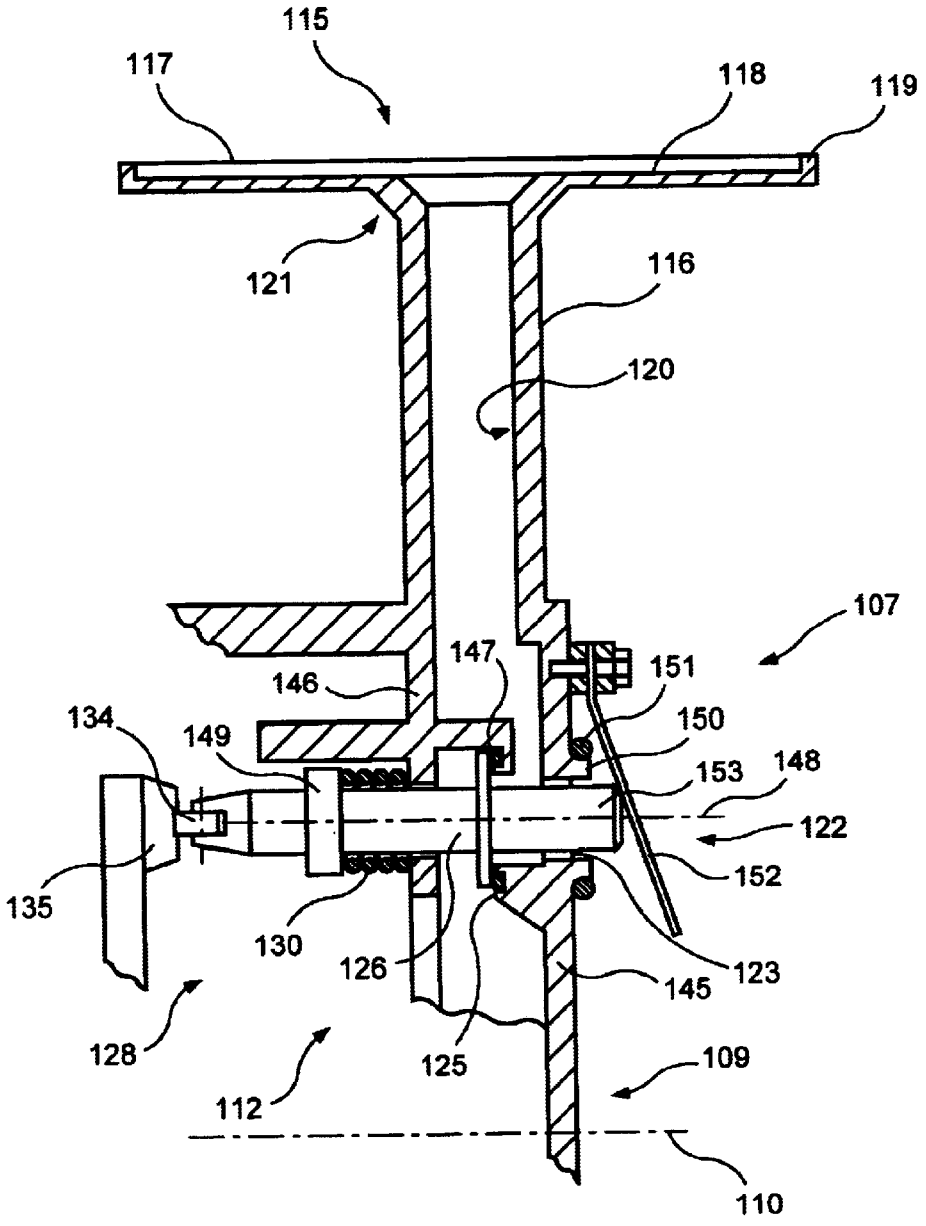
FIG. 6 shows a cross section of the gripping unit of FIG. 5 in a second operating position.

With reference to FIGS. 5 and 6, with reference numeral 107 is shown a gripping unit, wherein all such parts of the gripping unit 107, which are identical with or clearly analogous to the parts of the previous embodiment will be designated by the same reference numeral plus 100.

The gripping unit 107 of FIGS. 5 and 6 has a plurality of gripping heads 115 arranged about a roller 109 rotating about an axis 110. Each gripping head is supported by a radial arm 116 and connected to the chamber 112 by a conduit 120, which extends partially inside the arm 116 and partially between a front wall 145 of the powered roller 109 and a wall 146 located in the chamber 112. Conduit 120 houses a valve 122 for controlling conduit 120, i.e. for opening or closing conduit 120 to connect or disconnect the cavity 118 from the chamber 112.

Each valve 122 comprises a head 124, an annular seat 125 supported by walls 145 and 146, an O-ring 147 fitted to the annular seat 125, and a control rod 126, which extends along an axis 148 parallel to axis 10 and reciprocated along axis 148 by an actuating device 128. Control rod 126 is supported by a passage in the wall 146, and supports an annular ring 149 and the head 124.

Actuating device 128 comprises a spring 130 arranged between wall 146 and ring 149 for keeping the valve 122 in the open position, and a tappet roller 134 at one distal end of the rod 126 and a fixed cam 135 located inside the chamber 112 and cooperating with the tapped roller 134 for closing the valve 122 as shown in FIG. 6.

The gripping unit 107 comprises a venting hole 123 located along conduit 120 in front of the valve 122 and substantially coaxial with the seat 125. The venting hole 123 is made through the front wall 145, is enclosed by an annular projection 150 of the front wall 145 supporting an O-ring. 151, and is closed by a leaf spring 152 mounted on to the external surface of front wall 145 and urged against the O-ring 151. Control rod 126 has a distal end 153 opposite to the end provided with the tappet roller 134 and cooperating with the leaf spring 152 in order to push away the leaf spring 152 from the conduit 120 in order to open the venting hole 123 as soon as the rod 126 moves the valve head 124 toward the closed position. In the open position of the valve 122, the distal end 153 is located in closed proximity to the leaf spring 152 so as to the control rod 126 when pushed in the right direction in FIG. 5 first open the venting hole 123 and then closes valve 122. Such a sequence permits re-establishing the atmospheric pressure in the cavity 118 as soon as the venting hole is open because the venting hole 123 neutralizes the vacuum generated through the valve 122 still partially open.

What is claimed is:

1. A suction gripping unit comprising at least a gripping head mounted for rotation about an axis and having at least one cavity defined in said suction head; suction means for creating a vacuum inside said cavity, said suction means comprising a conduit communicating with said cavity, a suction pump connected to said conduit and a control valve located between said pump and said cavity and movable between an open position in which said cavity is in communication with the pump and in a closed position in which said valve interrupts the communication between the cavity and the pump; wherein the suction gripping unit further comprises at least a venting hole in close proximity to the valve for automatically venting said cavity when said valve is in the closed position, and a rod connected to said valve to move the valve between the open position and the closed position for respectively opening and closing said conduit, said valve being located along said conduit, said venting hole being located along said conduit in correspondence with the valve, said venting hole being closed by a leaf spring urged against the venting hole; said rod being structured to open said venting hole when the rod closes the valve by pushing the leaf spring away from the venting hole.

2. A unit as claimed in claim 1, wherein said suction pump is of the "side-channel" type.

3. A unit as claimed in claim 1, further comprising a tappet roller connected mechanically to said rod; and a fixed cam engaged by said tappet roller to cyclically move said rod.

4. A unit as claimed in claim 1, wherein said venting hole is located in front of said valve.

5. A device for supplying blanks to a packing wheel having a number of seats, each for receiving a respective said blank; the device comprising a pickup station at a store for storing said blanks, and a supply station at said packing wheel (2), and being characterized by comprising a suction gripping unit as claimed in claim 1 and comprising a plurality of said gripping heads for feeding each said blank from said store to a respective said seat.

6. A device as claimed in claim 5, wherein said, suction head is so formed as to be inserted inside the respective said seat at said supply station and is structured to fold said blank into a U-shape inside the seat.

* * * * *